US007513738B2

(12) United States Patent
Itzel et al.

(10) Patent No.: US 7,513,738 B2
(45) Date of Patent: Apr. 7, 2009

(54) METHODS AND APPARATUS FOR COOLING GAS TURBINE ROTOR BLADES

(75) Inventors: Gary Michael Itzel, Simpsonville, SC (US); Ariel Caesar Prepena Jacala, Simpsonville, SC (US); Doyle C. Lewis, Greer, SC (US); Calvin Levy Sims, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 96 days.

(21) Appl. No.: 11/355,213

(22) Filed: Feb. 15, 2006

(65) Prior Publication Data

US 2007/0189896 A1 Aug. 16, 2007

(51) Int. Cl.
*F01D 5/18* (2006.01)

(52) U.S. Cl. ..... 415/115; 416/96 R; 416/90 R

(58) Field of Classification Search ..... 415/115, 415/116; 416/96 R, 90 R, 97 R
See application file for complete search history.

(56) References Cited

U.S. PATENT DOCUMENTS 6,132,173 A * 10/2000 Tomita et al. ..... 416/96 R
6,186,741 B1 * 2/2001 Webb et al. ..... 416/96 R
6,190,130 B1 * 2/2001 Fukue et al. ..... 416/97 R
6,334,295 B1 1/2002 Eldrid et al.
6,334,756 B1 1/2002 Akiyama et al.
6,431,820 B1 8/2002 Beacock et al.
6,514,038 B2 2/2003 Akiyama et al.
6,561,758 B2 5/2003 Rinck et al.
6,923,616 B2 8/2005 McRae, Jr. et al.
6,984,112 B2 1/2006 Zhang et al.

* cited by examiner

*Primary Examiner*—Edward Look
*Assistant Examiner*—Dwayne J White
(74) *Attorney, Agent, or Firm*—Armstrong Teasdale LLP

(57) ABSTRACT

Methods and apparatus for cooling rotor blades of a gas turbine are provided. The turbine blade has an airfoil connected to the platform and a dovetail extending from the platform. A main cooling circuit extends through the dovetail and into the airfoil. The main cooling circuit includes an exit for main cooling flow from the airfoil to exit out through the dovetail. In one aspect, the method includes the steps of extracting a portion of the coolant flowing through the main cooling circuit into a platform cooling circuit. After cooling a portion of the platform, the platform cooling flow splits with one portion of the flow rejoining the main cooling circuit and is used to cool the airfoil. The rest of the platform cooling flow continues to cool the platform and then returns to the main cooling circuit to flow through the exit.

20 Claims, 4 Drawing Sheets

METHODS AND APPARATUS FOR COOLING GAS TURBINE ROTOR BLADES

BACKGROUND OF THE INVENTION

This invention relates generally to gas turbine engines and more particularly, to methods and apparatus for cooling gas turbine engine rotor assemblies.

A typical gas turbine engine includes a rotor assembly having circumferentially-spaced rotor blades. Each rotor blade, sometimes referred to as a bucket, includes an airfoil that extends radially outward from a platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

With respect to gas turbine operation, increasing inlet firing temperatures provides improved output and engine efficiencies. Increasing the inlet firing temperature results in increased gas path temperatures. Such increased gas path temperatures can result in added stress to the bucket platforms, including possibly oxidation, creep and cracking. Further, in gas turbines where closed loop cooling circuits are used in upstream airfoil components, there is no film cooling and therefore the downstream bucket platforms do not have the benefit from the film carryover from the upstream airfoils. This exacerbates the potential distress on the bucket platforms.

Some recent known turbine blade configurations do utilize film cooling for cooling the blade platform. Specifically, compressor discharge air is routed through an opening or openings in the platform, and a layer of cooling film forms on the platform to protect the platform from the high flow path temperatures. With such film cooling, however, there may only be sufficient pressure to film cool the aft section of the platform where the flow path air has been accelerated to drop the local static pressure.

BRIEF DESCRIPTION OF THE INVENTION

In one aspect, a method for cooling a platform of a turbine blade is provided. The turbine blade has an airfoil connected to the platform and a dovetail extending from the platform. A main cooling circuit extends through the dovetail and into the airfoil. The main cooling circuit includes an exit for main cooling flow from the airfoil to exit out through the dovetail. The method includes the steps of extracting a portion of the coolant flowing through the main cooling circuit into a platform cooling circuit, and then returning the coolant from the platform cooling circuit back into the main cooling circuit to flow through the exit.

In another aspect, a turbine blade is provided. The turbine blade includes a platform, a dovetail and an airfoil having a leading edge, a trailing edge, a pressure sidewall, and a suction sidewall. The airfoil is connected to the platform. The turbine blade further includes a main cooling circuit extending through the dovetail and into the airfoil. The main cooling circuit includes an exit for main cooling flow from the airfoil to exit out through the dovetail. The turbine blade also includes a platform cooling circuit in flow communication with the main cooling circuit. The platform circuit includes an inlet for extracting a portion of coolant flowing through the main cooling circuit into the platform circuit, and an outlet through which coolant exits the platform cooling circuit.

In yet another aspect, a rotor assembly for a gas turbine is provided. The rotor assembly includes a rotor shaft and a plurality of circumferentially-spaced rotor blades coupled to the rotor shaft. Each rotor blade includes a platform, a dovetail and an airfoil having a leading edge, a trailing edge, a pressure sidewall, and a suction sidewall. The airfoil is connected to the platform. The turbine blade further includes a main cooling circuit extending through the dovetail and into the airfoil. The main cooling circuit includes an exit for main cooling flow from the airfoil to exit out through the dovetail. The turbine blade also includes a platform cooling circuit in flow communication with the main cooling circuit. The platform circuit includes an inlet for extracting a portion of coolant flowing through the main cooling circuit into the platform circuit, and an outlet through which coolant exits the platform cooling circuit.

DETAILED DESCRIPTION OF THE INVENTION

Generally, and as set forth below in more detail, a rotor blade includes a main cooling circuit. The main cooling circuit extends through the dovetail and into the airfoil. Such main cooling circuit then extends from the airfoil back through the dovetail. In one embodiment, rotor blade platform cooling is provided by extracting a portion of coolant flow supplied to the airfoil from the main cooling circuit and running the coolant through a serpentine passage, or platform circuit, in the platform to convectively cool the platform. A portion of the platform serpentine cooling flow is bled off the platform circuit to feed an airfoil cooling circuit in the airfoil which cools a portion of the airfoil, and such coolant flow is then rejoined with the main airfoil cooling flow. The remainder of the platform serpentine coolant flow continues to convectively cool the bucket platform, and is then returned to the main cooling circuit and flows to an exit.

Figure 1:
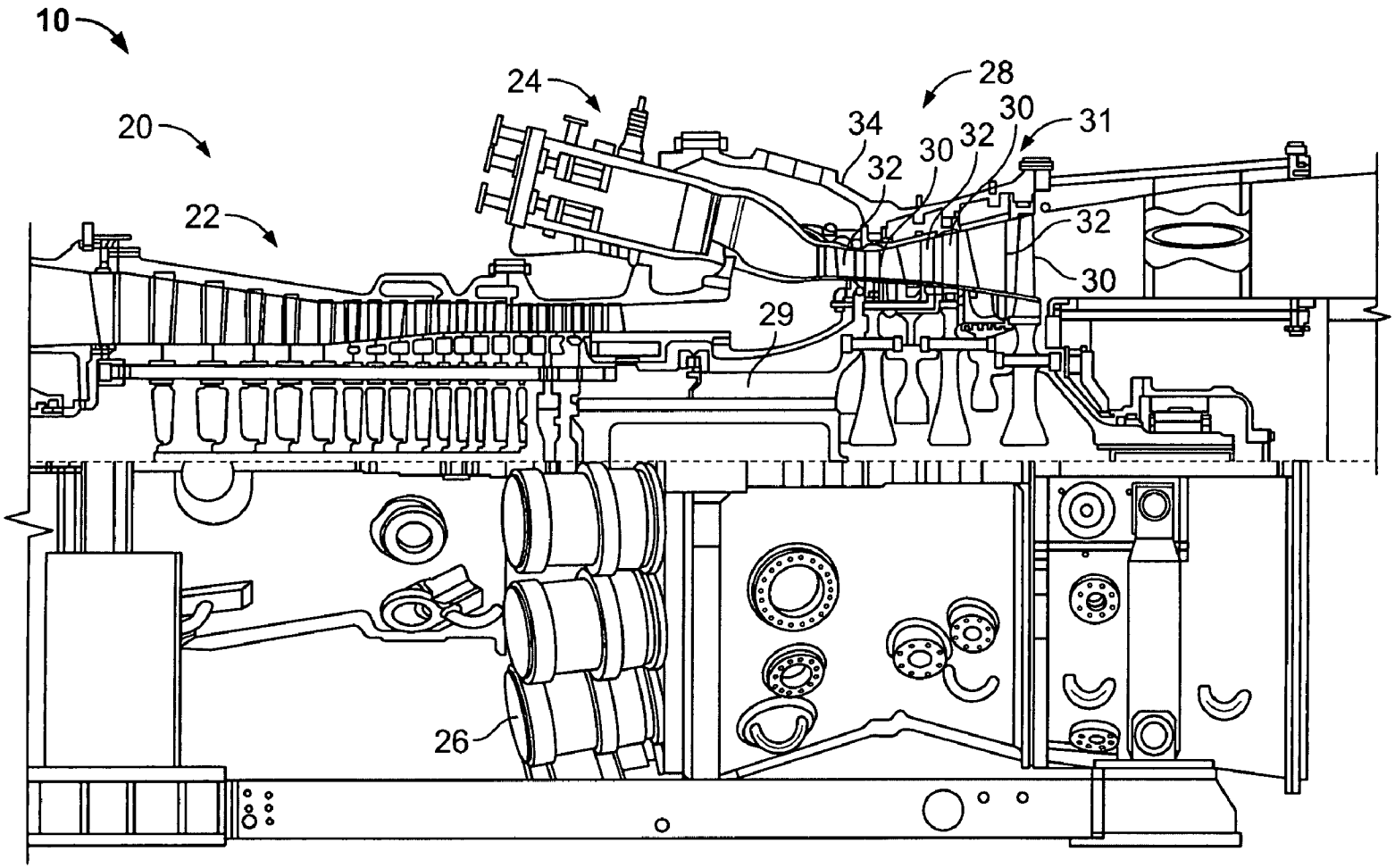
FIG. 1 is a side cutaway view of a gas turbine system that includes a gas turbine

In the one embodiment, the platform serpentine cooling circuit is a cast-in feature integral with the platform. Alternatively, such circuit is partially cast with an attached cover plate to secure to the platform. To augment the heat transfer from the platform to the coolant, turbulators can be used in the circuit. Such platform cooling circuit can be used in connection with a closed loop steam cooled bucket as well as with an air-cooled bucket Referring to the drawings, FIG. 1 is a side cutaway view of a gas turbine system 10 that includes a gas turbine 20. Gas turbine 20 includes a compressor section 22, a combustor section 24 including a plurality of combustor cans 26, and a turbine section 28 coupled to compressor section 22 using a shaft 29. A plurality of turbine blades 30 are connected to turbine shaft 29. Between turbine blades 30 there is positioned a plurality of non-rotating turbine nozzle stages 31 that include a plurality of turbine nozzles 32. Turbine nozzles 32 are connected to a housing or shell 34 surrounding turbine blades 30 and nozzles 32. Hot gases are directed through nozzles 32 to impact blades 30 causing blades 30 to rotate along with turbine shaft 29.

In operation, ambient air is channeled into compressor section 22 where the ambient air is compressed to a pressure greater than the ambient air. The compressed air is then channeled into combustor section 24 where the compressed air and a fuel are combined to produce a relatively high-pressure, high-velocity gas. Turbine section 28 is configured to extract the energy from the high-pressure, high-velocity gas flowing from combustor section 24. Gas turbine system 10 is typically controlled, via various control parameters, from an automated and/or electronic control system (not shown) that is attached to gas turbine system 10.

Figure 2:
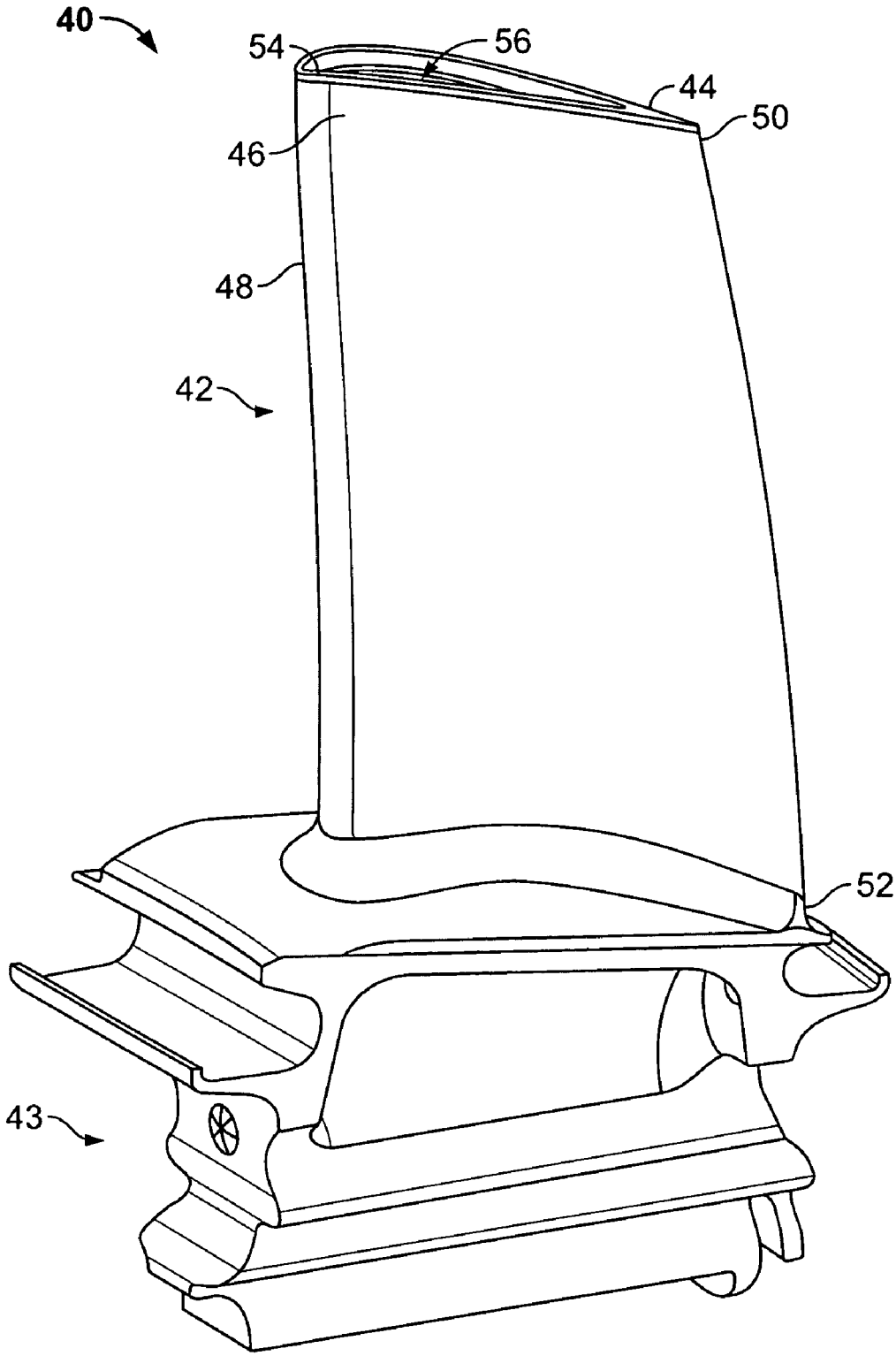
FIG. 2 is a perspective schematic illustration of an example rotor blade.

FIG. 2 is a perspective schematic illustration of a rotor blade 40 that may be used with gas turbine engine 20 In an exemplary embodiment, a plurality of rotor blades 40 form a high pressure turbine rotor blade stage (not shown) of gas turbine engine 20. Each rotor blade 40 includes a hollow airfoil 42 and an integral dovetail 43 used for mounting airfoil 42 to a rotor disk (not shown) in a known manner.

Airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are connected at a leading edge 48 and at an axially-spaced trailing edge 50 of airfoil 42 that is downstream from leading edge 48.

First and second sidewalls 44 and 46, respectively, extend longitudinally or radially outward to span from a blade root 52 positioned adjacent dovetail 43 to a top plate 54 which defines a radially outer boundary of an internal cooling circuit or chamber 56. Cooling circuit 56 is defined within airfoil 42 between sidewalls 44 and 46. Internal cooling of airfoils 42 is known in the art. In the exemplary embodiment, cooling circuit 56 includes a serpentine passage cooled with compressor bleed air or steam.

Figure 3:
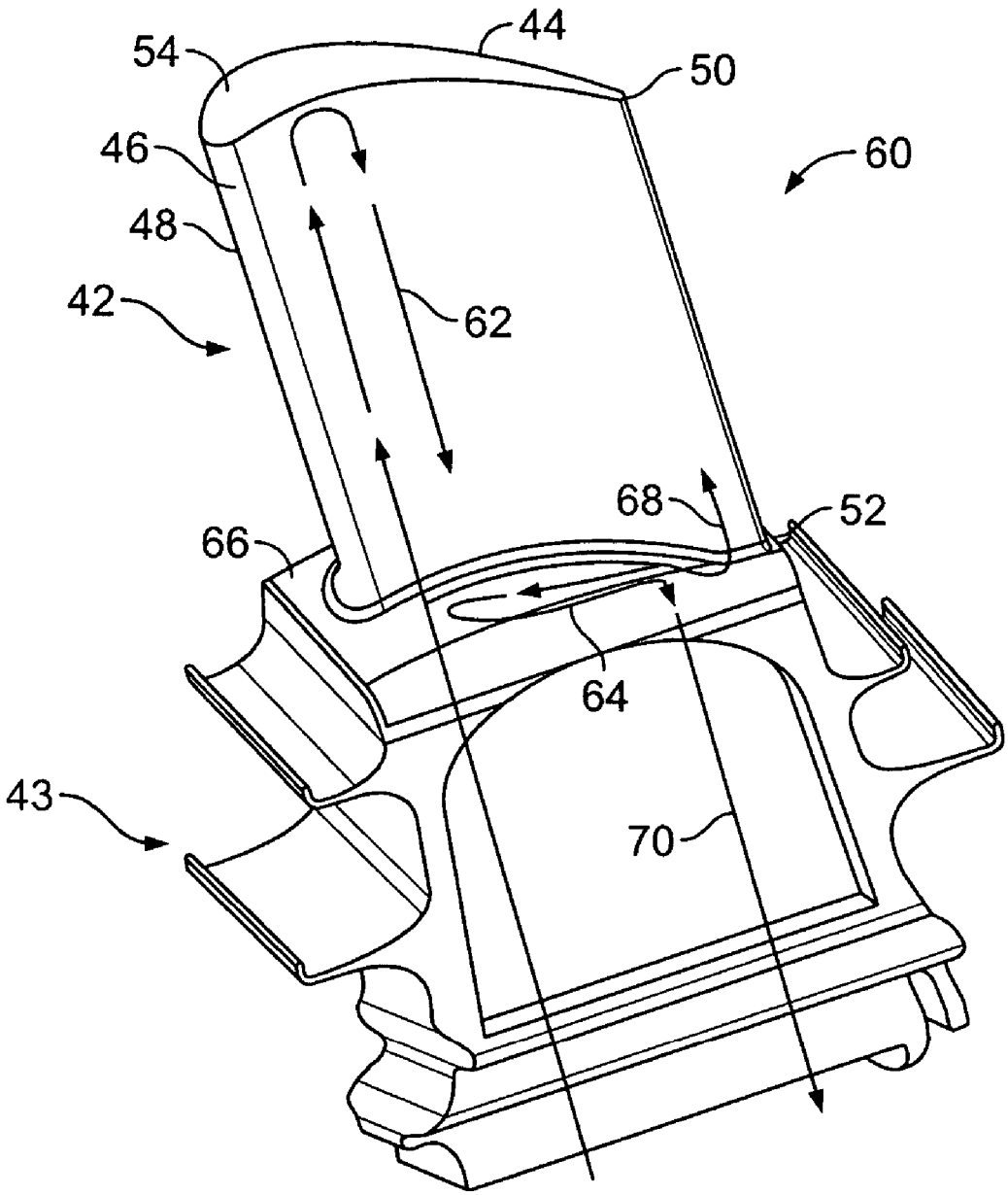
FIG. 3 is a perspective schematic illustration of another example rotor blade in partial cross section.

FIG. 3 is a perspective schematic illustration of another example rotor blade 60 in partial cross section. Components of blade 60 that are the same as components of blade 40 shown in FIG. 2, are identified in FIG. 3 using the same reference numerals as used in FIG. 2. Specifically, as shown in FIG. 3, a main cooling circuit 62 extends through rotor blade. Specifically, main cooling circuit 62 extends through dovetail 43 and into airfoil 42. Such main cooling circuit 62 then extends from airfoil 42 back through dovetail 43.

In one embodiment, rotor blade platform cooling is provided by extracting a portion of coolant flow supplied to the airfoil from main cooling circuit 62 and running the coolant through a serpentine passage, or platform circuit 64, in platform 66 to convectively cool platform 66. A portion of the platform serpentine cooling flow is bled off platform circuit 64 to feed an airfoil cooling circuit 68 in airfoil 42 which cools a portion of airfoil 42, and such coolant flow is then rejoined with the main airfoil cooling flow. The remainder of the platform serpentine coolant flow continues to convectively cool bucket platform 66, and is then returned to the main cooling circuit 66 and flows through main cooling circuit exit 70.

Figure 4:
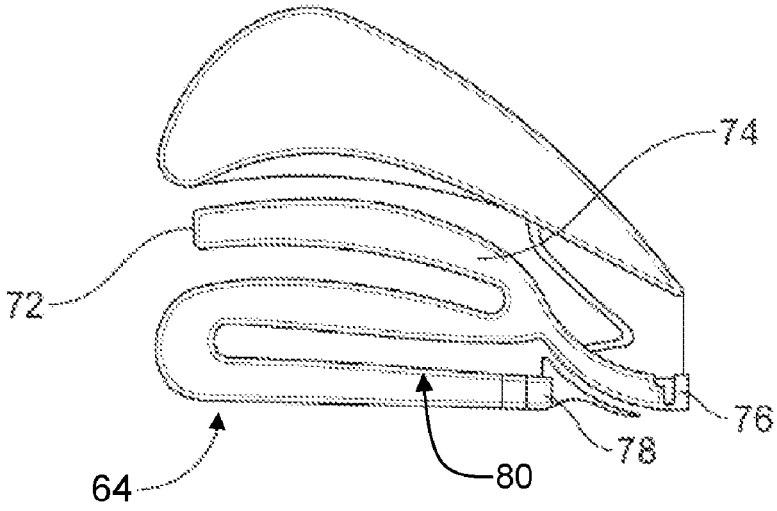
FIG. 4 is a top view of an example platform serpentine cooling circuit.
Figure 5:
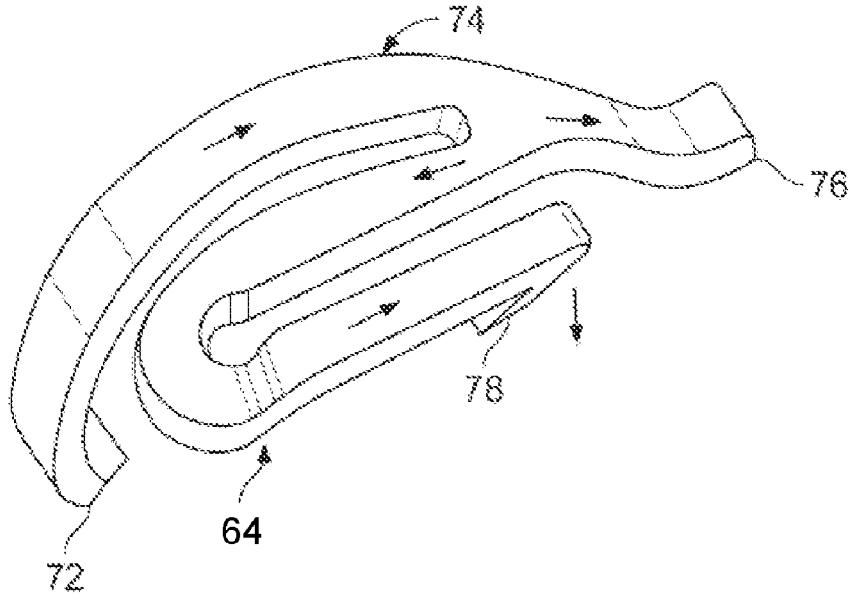
FIG. 5 is a perspective view of the platform serpentine cooling circuit shown in FIG. 4.

FIG. 4 is a top view of platform serpentine cooling circuit 64, and FIG. 5 is a perspective view of platform circuit 64. Referring to FIGS. 4 and 5, circuit 64 includes an inlet 72 so that a portion of coolant flow typically supplied to airfoil is bled off from main cooling circuit 62 to platform cooling circuit 64. Platform circuit 64 also includes a serpentine section, or portion 74, for facilitating heat transfer from platform 66 to coolant flowing through circuit 64. Circuit 64 also includes an airfoil outlet 76 so that a portion of the platform serpentine cooling flow is bled off platform circuit 64 to feed airfoil cooling circuit 68 in airfoil 42 which cools a portion of airfoil 42, and such coolant flow is then rejoined with the main airfoil cooling flow. The remainder of the platform serpentine coolant flow continues to convectively cool bucket platform 66. Platform circuit 64 further includes an outlet 78 so that coolant that has flowed completely through circuit 64 exits, into main cooling circuit 62 and flows through main cooling circuit exit 70.

In the one embodiment, the platform serpentine cooling circuit is a cast-in feature integral with the platform. Specifically, the circuit can be formed using ceramic cores or using a wax in a lost wax casting process. In the lost wax casting process, a plate typically would be welded or brazed to the platform to totally enclose the circuit within the platform. To augment the heat transfer from the platform to the coolant, turbulators 80 can be used in the circuit. Such platform cooling circuit can be used in connection with a closed loop steam cooled bucket as well as with an air-cooled bucket.

The above described platform cooling facilitates operating a gas turbine with increased inlet firing temperatures so that improved output and engine efficiencies that can be gained with such increased inlet firing temperatures without added stress to the bucket platforms. In addition, such platform cooling facilitates cooling the entire platform and not just aft sections of the platform, such as with film cooling under certain operating conditions.

While the invention has been described in terms of various specific embodiments, those skilled in the art will recognize that the invention can be practiced with modification within the spirit and scope of the claims.

What is claimed is:

1. A method for cooling a platform of a turbine blade, the turbine blade having an airfoil connected to the platform and a dovetail extending from the platform, a main cooling circuit extending through the dovetail and into the airfoil, the main cooling circuit including an exit for main cooling flow from the airfoil to exit out through the dovetail, said method comprising the steps of:

extracting a portion of the coolant flowing through the main cooling circuit into a platform cooling circuit defined within the platform of the turbine blade;

discharging the coolant from the platform cooling circuit such that a first portion of the coolant is channeled directly to the exit, and such that a second portion of the coolant is channeled into a separate airfoil cooling circuit that is at least partially defined within the airfoil.

2. A method in accordance with claim 1 wherein the platform cooling circuit has a serpentine shaped section.

3. A method in accordance with claim 1 further comprising rejoining the extracted second portion of the coolant flow with the main cooling circuit.

4. A method in accordance with claim 1 wherein the platform circuit is formed using ceramic cores.

5. A method in accordance with claim 1 wherein the platform circuit is formed using a lost wax casting process.

6. A method in accordance with claim 1 wherein the platform circuit includes turbulators.

7. A method in accordance with claim 1 wherein the platform circuit coolant is one of steam and air.

8. A turbine blade, comprising:

a platform;

a dovetail;

an airfoil comprising a leading edge, a trailing edge, a pressure sidewall, and a suction sidewall, said airfoil connected to said platform;

a main cooling circuit extending through the dovetail and into the airfoil, said main cooling circuit comprising an exit for main cooling flow from said airfoil to exit out through said dovetail; and a platform cooling circuit defined within said platform and in flow communication with said main cooling circuit, said platform circuit comprising an inlet for extracting a portion of coolant flowing through said main cooling circuit into said platform circuit, a first outlet through which a portion of the coolant from the platform cooling circuit is discharged directly into said main cooling circuit and a second outlet through which coolant exits said platform cooling circuit, and is channeled into a separate airfoil cooling circuit that is at least partially defined within the airfoil.

9. A turbine blade in accordance with claim 8 wherein said platform circuit outlet is connected to said main cooling circuit so that coolant from said platform circuit mixes with coolant in said main cooling circuit and exits out through said dovetail.

10. A turbine blade in accordance with claim 8 wherein at least a portion of said platform cooling circuit has a serpentine shape.

11. A turbine blade in accordance with claim 8 wherein said platform cooling circuit further comprises an airfoil outlet through which a portion of coolant flowing through said platform cooling circuit exits to cool at least a portion of said airfoil, said portion of coolant rejoins said main cooling circuit prior to exiting said turbine blade.

12. A turbine blade in accordance with claim 8 wherein said platform circuit is formed using ceramic cores.

13. A turbine blade in accordance with claim 8 wherein said platform circuit comprises turbulators.

14. A turbine blade in accordance with claim 8 wherein the platform circuit coolant is one of steam and air.

15. A rotor assembly for a gas turbine, said rotor assembly comprising:

a rotor shaft; and a plurality of circumferentially-spaced rotor blades coupled to said rotor shaft, each said rotor blade comprising:

a platform;

a dovetail;

an airfoil comprising a leading edge, a trailing edge, a pressure sidewall, and a suction sidewall, said airfoil connected to said platform;

a main cooling circuit extending through the dovetail and into the airfoil, said main cooling circuit comprising an exit for main cooling flow from said airfoil to exit out through said dovetail; and a platform cooling circuit defined within said platform and in flow communication with said main cooling circuit, said platform circuit comprising an inlet for extracting a portion of coolant flowing through said main cooling circuit into said platform circuit, a first outlet through which a portion of the coolant from the platform cooling circuit is discharged directly into said main cooling circuit and a second outlet through which coolant exits said platform cooling circuit, and is channeled to a separate airfoil cooling circuit that is at least partially defined within said airfoil.

16. A rotor assembly in accordance with claim 15 wherein said platform circuit outlet is connected to said main cooling circuit so that coolant from said platform circuit mixes with coolant in said main cooling circuit and exits out through said dovetail.

17. A rotor assembly in accordance with claim 15 wherein at least a portion of said platform cooling circuit has a serpentine shape.

18. A rotor assembly in accordance with claim 15 wherein said platform cooling circuit further comprises an airfoil outlet through which a portion of coolant flowing through said platform cooling circuit exits to cool at least a portion of said airfoil and said portion of coolant rejoins said main cooling circuit prior to exiting said rotor blade.

19. A rotor assembly in accordance with claim 15 wherein said platform circuit comprises turbulators.

20. A rotor assembly in accordance with claim 15 wherein the platform circuit coolant is one of steam and air.

* * * * *